US007936268B2

(12) United States Patent
Tuttle

(10) Patent No.: US 7,936,268 B2
(45) **Date of Patent: *May 3, 2011**

(54) SELECTIVELY COUPLING TO FEED POINTS OF AN ANTENNA SYSTEM

(75) Inventor: John R Tuttle, Boulder, CO (US)

(73) Assignee: Round Rock Research, LLC, Mt. Kisco, NY (US)

( * ) Notice: Subject to any disclaimer, the term of this patent is extended or adjusted under 35 U.S.C. 154(b) by 535 days.

This patent is subject to a terminal disclaimer.

(21) Appl. No.: 11/848,295

(22) Filed: Aug. 31, 2007

(65) Prior Publication Data

US 2009/0058649 A1 Mar. 5, 2009

(51) Int. Cl.
*G08B 13/14* (2006.01)

(52) U.S. Cl. ..... 340/572.1; 340/572.7; 340/10.1; 340/10.4

(58) Field of Classification Search ..... 340/572.7
See application file for complete search history.

(56) References Cited

U.S. PATENT DOCUMENTS

| | | | | |
|---|---|---|---|---|
| 2,256,619 | A | | 9/1941 | Luck |
| 3,721,990 | A | | 3/1973 | Gibson et al. |
| 3,727,230 | A | | 4/1973 | Doi |
| 3,859,652 | A | | 1/1975 | Hall et al. |
| 3,967,202 | A | | 6/1976 | Batz |
| 4,016,553 | A | | 4/1977 | Novikoff et al. |
| 4,075,632 | A | | 2/1978 | Baldwin et al. |
| 4,260,983 | A | | 4/1981 | Falck et al. |
| 4,274,083 | A | | 6/1981 | Tomoeda |
| 4,333,072 | A | | 6/1982 | Beigel |
| 4,401,952 | A | * | 8/1983 | Basawapatna ..... 330/277 |
| 4,510,495 | A | | 4/1985 | Sigrimis et al. |
| 4,525,713 | A | | 6/1985 | Barletta et al. |
| 4,539,660 | A | | 9/1985 | Miyauchi et al. |
| 4,572,976 | A | | 2/1986 | Fockens |
| 4,596,988 | A | | 6/1986 | Wanka |
| 4,630,044 | A | | 12/1986 | Polzer |
| 4,641,374 | A | | 2/1987 | Oyama |
| 4,646,090 | A | | 2/1987 | Mawhinney |
| 4,651,157 | A | | 3/1987 | Gray et al. |
| 4,654,658 | A | | 3/1987 | Walton |
| 4,656,472 | A | | 4/1987 | Walton |
| 4,724,427 | A | | 2/1988 | Carroll |
| 4,730,188 | A | | 3/1988 | Millheiser |
| 4,740,792 | A | | 4/1988 | Sagey et al. |
| 4,782,342 | A | | 11/1988 | Walton |

(Continued)

OTHER PUBLICATIONS

O'Toole, James E., U.S. Appl. No. 60/017,900, filed May 13, 1996.

(Continued)

*Primary Examiner* — Benjamin C Lee
*Assistant Examiner* — Curtis J King
(74) *Attorney, Agent, or Firm* — Lerner, David, Littenberg, Kromholz & Mentlik, LLP

(57) ABSTRACT

Selectively coupling to feed points of an antenna system. At least some of the illustrative embodiments are systems comprising an antenna system, an antenna communication circuit, a first diode coupled between the antenna communication circuit and a first feed point of the antenna system, and a second diode coupled between the antenna communication circuit and a second feed point of the antenna system. The antenna communication circuit is configured to couple the antenna communication circuit to the first and second feed points by forward biasing the diodes.

14 Claims, 6 Drawing Sheets

U.S. PATENT DOCUMENTS

| | | | | |
|---|---|---|---|---|
| RE32,856 | E | 2/1989 | Millsap et al. | |
| 4,809,009 | A | 2/1989 | Grimes et al. | |
| 4,819,053 | A | 4/1989 | Halavais | |
| 4,822,990 | A | 4/1989 | Tamada et al. | |
| 4,854,328 | A | 8/1989 | Pollack | |
| 4,857,893 | A | 8/1989 | Carroll | |
| 4,862,160 | A | 8/1989 | Ekchian et al. | |
| 4,870,419 | A | 9/1989 | Baldwin et al. | |
| 4,888,591 | A | 12/1989 | Landt et al. | |
| 4,890,072 | A | 12/1989 | Espe et al. | |
| 4,890,075 | A | 12/1989 | Pohlmann et al. | |
| 4,904,983 | A | 2/1990 | Mitchell | |
| 4,912,471 | A | 3/1990 | Tyburski et al. | |
| 4,918,458 | A | 4/1990 | Brenner et al. | |
| 4,920,450 | A * | 4/1990 | Masiulis | 361/282 |
| 4,926,182 | A | 5/1990 | Ohta et al. | |
| 4,937,581 | A | 6/1990 | Baldwin et al. | |
| 5,046,130 | A | 9/1991 | Hall et al. | |
| 5,051,726 | A | 9/1991 | Copeland et al. | |
| 5,055,851 | A | 10/1991 | Sheffer | |
| 5,084,699 | A | 1/1992 | DeMichele | |
| 5,086,389 | A | 2/1992 | Hassett et al. | |
| 5,103,235 | A | 4/1992 | Clemens | |
| 5,126,749 | A | 6/1992 | Kaltner | |
| 5,134,085 | A | 7/1992 | Gilgen et al. | |
| 5,136,719 | A | 8/1992 | Gaskill et al. | |
| 5,142,292 | A | 8/1992 | Chang | |
| 5,144,314 | A | 9/1992 | Malmberg et al. | |
| 5,164,985 | A * | 11/1992 | Nysen et al. | 380/271 |
| 5,175,774 | A | 12/1992 | Truax et al. | |
| 5,198,826 | A | 3/1993 | Ito | |
| 5,272,367 | A | 12/1993 | Denninson et al. | |
| 5,287,112 | A | 2/1994 | Schuermann | |
| 5,300,875 | A | 4/1994 | Tuttle | |
| 5,323,150 | A | 6/1994 | Tuttle | |
| 5,334,974 | A | 8/1994 | Simms et al. | |
| 5,365,551 | A | 11/1994 | Snodgrass et al. | |
| 5,374,930 | A | 12/1994 | Schuermann | |
| 5,406,263 | A | 4/1995 | Tuttle | |
| 5,420,757 | A | 5/1995 | Eberhardt et al. | |
| 5,446,447 | A | 8/1995 | Carney et al. | |
| 5,448,110 | A | 9/1995 | Tuttle et al. | |
| 5,448,242 | A | 9/1995 | Sharpe et al. | |
| 5,461,385 | A | 10/1995 | Armstrong | |
| 5,471,212 | A | 11/1995 | Sharpe et al. | |
| 5,479,172 | A | 12/1995 | Smith et al. | |
| 5,479,416 | A | 12/1995 | Snodgrass et al. | |
| 5,489,546 | A | 2/1996 | Ahmad et al. | |
| 5,500,650 | A | 3/1996 | Snodgrass et al. | |
| 5,519,621 | A | 5/1996 | Wortham | |
| 5,521,600 | A | 5/1996 | McEwan | |
| 5,525,993 | A | 6/1996 | Pobanz et al. | |
| 5,572,226 | A | 11/1996 | Tuttle | |
| 5,621,412 | A | 4/1997 | Sharpe et al. | |
| 5,649,296 | A | 7/1997 | MacLellan et al. | |
| 5,656,978 | A | 8/1997 | Bianu et al. | |
| 5,668,560 | A | 9/1997 | Evans et al. | |
| 5,719,586 | A | 2/1998 | Tuttle | |
| 5,894,266 | A | 4/1999 | Wood et al. | |
| 5,903,239 | A * | 5/1999 | Takahashi et al. | 343/700 MS |
| 5,970,398 | A | 10/1999 | Tuttle | |
| 6,122,494 | A | 9/2000 | Tuttle | |
| 6,243,013 | B1 * | 6/2001 | Duan et al. | 340/572.7 |
| 6,255,993 | B1 * | 7/2001 | Greeff et al. | 343/700 MS |
| 6,434,368 | B1 | 8/2002 | Standmark | |
| 6,466,131 | B1 | 10/2002 | Tuttle et al. | |
| 6,466,634 | B1 | 10/2002 | O'Toole et al. | |
| 6,574,454 | B1 | 6/2003 | Tuttle | |
| 7,209,080 | B2 | 4/2007 | Crouch et al. | |
| 2003/0174099 | A1 * | 9/2003 | Bauer et al. | 343/893 |
| 2005/0083179 | A1 * | 4/2005 | Carrender et al. | 340/10.4 |
| 2007/0152831 | A1 * | 7/2007 | Eisele | 340/572.7 |
| 2008/0159364 | A1 * | 7/2008 | Rofougaran | 375/219 |
| 2008/0266192 | A1 | 10/2008 | Tuttle et al. | |

OTHER PUBLICATIONS

Tuttle, Mark E., U.S. Appl. No. 60/023,321, filed Jul. 30, 1996.
Tuttle, John R., U.S. Appl. No. 11/740,393, filed Apr. 26, 2007.
Beebe, Paul, "High-Tech Rules Ada," The Idaho Statesman, Jul. 11, 1993, reprinted in "Micron Morning Report," Jul. 16, 1993.
Bernhard, J.T. et al., "A Commemoration of Deschamps' and Sichak's 'Microstrip Microwave Antennas:' 50 years of Development, Divergence, and New Directions," Proceedings of the 2003 Antenna Applications Symposium, pp. 189-230, Sep. 2003.
Kranz, Eric et al., "GPS Antenna Design and Performance Advancements: The Trimble Sephyr", Trimble GPS Engineeering and Construction Group, Sunnyvale, California, Pete Large, Trimble Integrated Surveying Group, Westminster, Colorado.
Tuttle, John R., "A Low-Power Spread Spectrum CMOS RFID for Radio Identification Applications," Conference Proceedings of RF Expo West, pp. 216-222, Mar. 22, 1994.
Tuttle, John, "Digital RF/ID Enhances GPS," Proceedings of the Second Annual Wireless Symposium, pp. 406-411, Feb. 15, 1994.
Vittoz, Eric et al., "CMOS Analog Integrated Circuits Based on Weak Inversion Operation," IEEE Journal of Solid State Circuits, vol. SC-12, No. 3, pp. 224-231, Jun. 1997.
Mitsubishi Motors Corporation, "Eclipse: Safety and Security," located at http://www.mitsubishi-motors.co.jp.r/ products/Eclipse/ eclipse_04.html, 1995.
Transponder News, "Amtech Awarded $5.6 Million Contract to Install and Maintain Toll Collection System," located at http://www.pix.za/trolley/news.html, Feb. 29, 1996.
Transponder News, "Amtech to Install Hands-Free AEI System for Tracking Dillard's Mortor Freight Fleet," located at http://www.pix.za/trolley/news.html, Feb. 21, 1996.
Transponder News, "Tagmaster Finds Wide Spread Applications," located at http://www.pix.za/trolley/news.html, Feb. 1996.
Transponder News, "Texas Instruments and Remote Systems Applications Make Effective TAG Team Against Auto Theft," located at http://pix.za/trolley/news.html, Jan. 6, 1995.
Tuttle, John R., U.S. Appl. No. 12/132,594, filed Jun. 3, 2008.
USPTO Transaction History of U.S. Appl. No. 12/132,594, filed Jun. 3, 2008, entitled "Systems and Methods to Selectively Connect Antennas to Receive and Backscatter Radio Frequency Signals."
Transaction History of related U.S. Appl. No. 08/422,007, filed Apr. 11, 1995, entitled "Spherical Antenna Pattern(s) From Antenna(s) Arranged in a Two-Dimensional Plane for Use in RFID Tags and Labels," now U. S. Patent No. 5,572,226.
Transaction History of related U.S. Appl. No. 08/584,788, filed Jan. 1, 1996, entitled "Spherical Antenna Pattern(s) From Antenna(s) Arranged in a Two-Dimensional Plane for Use in RFID Tags and Labels," now U. S. Patent No. 5,719,586.
Transaction History of related U.S. Appl. No. 08/656,530, filed May 30, 1996, entitled "Method and Apparatus for Remote Monitoring," now U.S. Patent No. 5,894,266.
Transaction History of related U.S. Appl. No. 08/704,965, filed Aug. 29, 1996, entitled "Radio Frequency Antenna with Current Controlled Sensitivity," now U.S. Patent No. 5,970,398.
Transaction History of related U.S. Appl. No. 09/172,714, filed Oct. 13, 1998, entitled "Radio Frequency Antenna with Current Controlled Sensitivity," now U.S. Patent No. 6,122,494.
Transaction History of related U.S. Appl. No. 09/542,800, filed Apr. 4, 2000, entitled "Radio Frequency Antenna with Current Controlled Sensitivity," now U.S. Patent No. 6,574,454.
Transaction History of related U.S. Appl. No. 11/740,393, filed Apr. 26, 2007, entitled "Methods and Systems of Changing Antenna Polarization."
Transaction History of related U.S. Appl. No. 12/132,594, filed Jun. 3, 2008, entitled "Systems and Methods to Selectively Connect Antennas to Receive and Backscatter Radio Frequency Signals."
Johnson, et al., "Data Transmission via Polarization Modulation of a 2.4 Ghz Circularly Polarized Radio Wave," Students of Advanced Laboratory, Dept of Physics, UMR.

* cited by examiner

SELECTIVELY COUPLING TO FEED POINTS OF AN ANTENNA SYSTEM

BACKGROUND

1. Field

At least some of the various embodiments are directed to coupling of an antenna communication circuit to feed points of an antenna system.

2. Description of the Related Art

Many systems have a need to radiate (i.e., send) or receive electromagnetic waves with varying electric field polarizations (hereafter just polarization.). In some systems, radiating or receiving electromagnetic waves with varying polarization is accomplished by multiple antennas, with each antenna configured to transmit an electromagnetic wave with a particular polarization (e.g. multiple dipole antennas in different physical orientations, multiple patch antennas in different physical orientations). In other systems, the radiating or receiving electromagnetic waves with varying polarization is accomplished by a single antenna (e.g. a patch antenna with multiple feed points). Efficient and low-loss mechanisms to switch between feed points (whether embodied on different antennas or the same antenna) are desirable.

BRIEF DESCRIPTION OF THE DRAWINGS

For a detailed description of various embodiments, reference will now be made to the accompanying drawings in which.

NOTATION AND NOMENCLATURE

Certain terms are used throughout the following description and claims to refer to particular system components. As one skilled in the art will appreciate, design and manufacturing companies may refer to the same component by different names. This document does not intend to distinguish between components that differ in name but not function. In the following discussion and in the claims, the terms "including" and "comprising" are used in an open-ended fashion, and thus should be interpreted to mean "including, but not limited to . . . ."

Also, the term "couple" or "couples" is intended to mean either an indirect or direct connection. Thus, if a first device couples to a second device, that connection may be through a direct connection or through an indirect connection via other intermediate devices and connections. Moreover, the term "system" means "one or more components" combined together. Thus, a system can comprise an "entire system," "subsystems" within the system, a single antenna with multiple feed points, a group of individual antennas, a radio frequency identification (RFID) tag, a RFID reader, or any other device comprising one or more components.

DETAILED DESCRIPTION OF DISCLOSED EMBODIMENTS

The various embodiments disclosed herein are discussed in the context of radio frequency identification (RFID) tags and antennas for RFID tags; however, the systems, antennas and methods discussed herein have application beyond RFID tags to other types of electromagnetic wave-based technologies. The discussion of any embodiment in relation to RFID tags is meant only to be illustrative of that embodiment, and not intended to intimate that the scope of the disclosure, including the claims, is limited to that embodiment.

Figure 1:
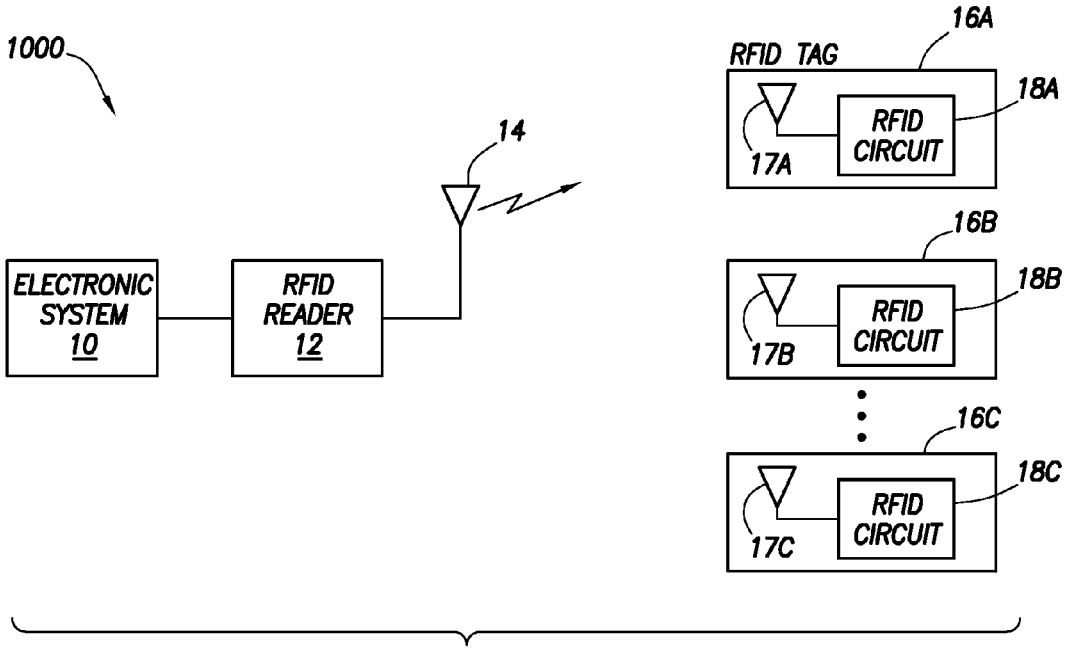
FIG. 1 shows a radio frequency identification (RFID) system in accordance with at least some embodiments.

FIG. 1 illustrates a system 1000 in accordance with at least some embodiments. In particular, system 1000 comprises an electronic system 10 (e.g. a computer system) coupled to a radio frequency identification (RFID) reader 12. The RFID reader 12 may be equivalently referred as an interrogator and/or an antenna communication circuit. By way of antenna system 14, the RFID reader 12 communicates with one or more RFID tags 16A-16C proximate to the RFID reader (i.e., within communication range).

Considering a single RFID tag 16A (but the description equally applicable to all the RFID tags 16A-16C), RFID tag 16A comprises a tag antenna system 17A which couples to an RFID circuit 18A. The RFID circuit 18A may also be referred to as an antenna communication circuit. The RFID circuit 18A implements in hardware (or a combination of hardware and software) various state machines, microprocessors, logic or other circuits to enable the RFID circuit 18A to receive signals from the RFID reader 12, and to respond to those signals in accordance with the various embodiments.

A communication sent by the RFID reader 12 is received by tag antenna system 17A, and passed to the RFID circuit 18A. In response to the communication, the RFID circuit 18 transmits to the RFID reader 12 the response (e.g. the electronic product code, user defined data and kill passwords) using the tag antenna system 17A. The RFID reader 12 passes data obtained from the various RFID tags 16 to the electronic system 10, which performs any suitable function.

There are several types of RFID tags operable in the illustrative system 1000. For example, RFID tags may be active tags, meaning each RFID tag comprises its own internal battery or other power source. Using power from the internal power source, an active RFID tag monitors for interrogating signals from the RFID reader 12. When an interrogating signal directed to the RFID tag is sensed, the tag response may be tag-radiated radio frequency (RF) power (with a carrier modulated to represent the data or identification value) using power from the internal battery or power source. A semi-active tag may likewise have its own internal battery or power source, but a semi-active tag remains dormant (i.e., powered-off or in a low power state) most of the time. When an antenna of a semi-active tag receives an interrogating signal, the power received is used to wake or activate the semi-active tag, and a response (if any) comprising an identification value is sent by modulating the RF backscatter from the tag antenna, with the semi-active tag using power for internal operations from its internal battery or power source. In particular, the RFID reader 12 and antenna system 14 continue to transmit power after the RFID tag is awake. While the RFID reader 12 transmits, the tag antenna system 17 of the RFID tag 16 is selectively tuned and de-tuned with respect to the carrier frequency. When tuned, significant incident power is absorbed by the tag antenna system 17. When de-tuned, significant power is reflected by the tag antenna system 17 to the antenna system 14 of the RFID reader 12. The data or identification value modulates the carrier to form the reflected or backscattered electromagnetic wave. The RFID reader 12 reads the data or identification value from the backscattered electromagnetic waves. Thus, in this specification and in the claims, the terms "transmitting" and "transmission" include not only sending from an antenna using internally sourced power, but also sending in the form of backscattered signals.

A third type of RFID tag is a passive tag, which, unlike active and semi-active RFID tags, has no internal battery or power source. The tag antenna system 17 of the passive RFID tag receives an interrogating signal from the RFID reader, and the power extracted from the received interrogating signal is used to power the tag. Once powered or "awake," the passive RFID tag may accept a command, send a response comprising a data or identification value, or both; however, like the semi-active tag the passive tag sends the response in the form of RF backscatter.

Figure 2:
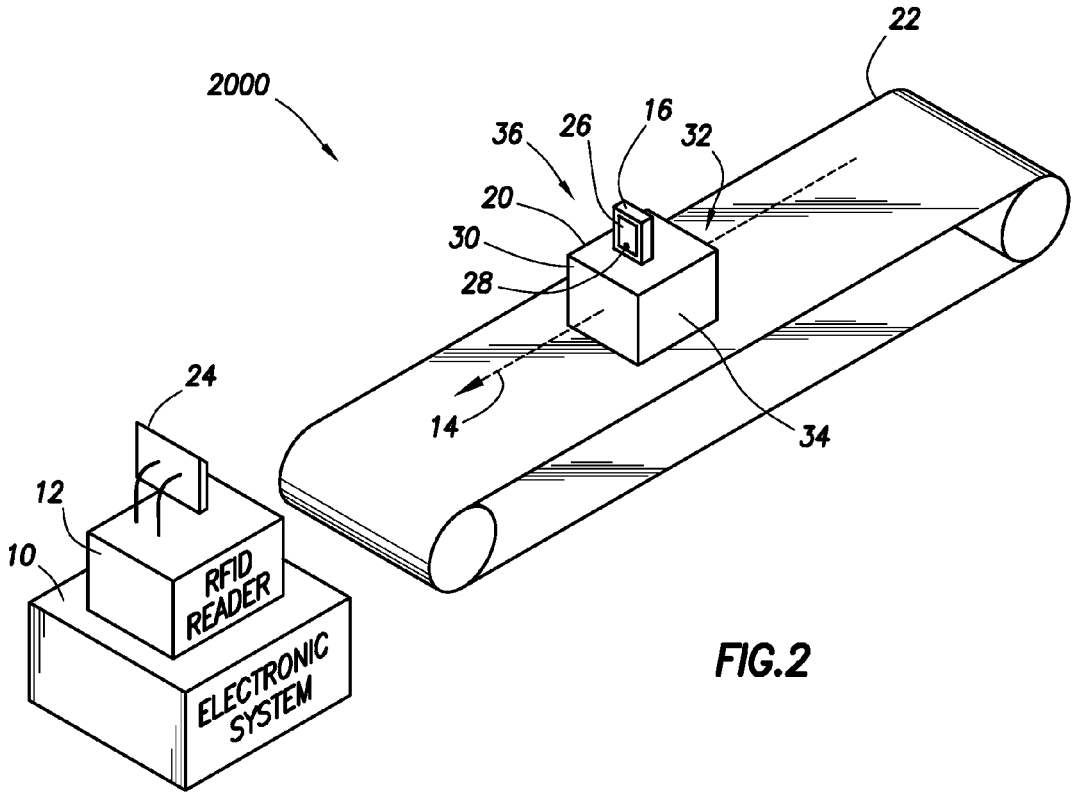
FIG. 2 shows RFID system in accordance with at least some embodiments.

FIG. 2 shows a more detailed system 2000 in accordance with some embodiments. In particular, system 2000 shows an object 20 on a conveyor system 22, and in some embodiments with the object 20 moving in the direction indicated by arrow 14. The object 20 has an associated RFID tag 16. Conveyor system 22 is illustrative of any situation where an object 20 may be in a plurality of positions relative to a system for reading the RFID tag 16, such as reading by RFID reader 12. For example, the object 20 and conveyor system 22 are illustrative of wafer boats in semiconductor manufacturing production line, luggage in an automated luggage handling system, parcels in an automated sorting facility, consumer goods in a shopping cart, or participants in a war game. The system 2000 further comprises a reading antenna system 24 positioned downstream of the direction of travel of the object 20. In other embodiments, the reading antenna system 24 may be placed at any suitable position. Electronic system 10 and RFID reader 12 couple to the reading antenna system 24, and the RFID reader 12 reads the RFID tag 16 using at least a portion of the reading antenna system 24.

The RFID reader 12 and/or electronic system 10 may be configured to determine certain physical characteristics of the RFID tag 16 and attached object 20. For example, the RFID reader 12 and/or electronic system 10 may be implemented in a system which determines which face or side of the object 20 is exposed to the reading antenna system 24, object 20 in these embodiments having faces 30 and 32, and sides 34 and 36. Likewise, the RFID reader 12 and/or electronic system 10 may be implemented to determine the rotational orientation of the object 20 (e.g. which side 34, 36 faces upwards). These and possibly other physical characteristics of the RFID tag 16 and attached object 20 may be determined by polarization of electromagnetic waves or signals transmitted by the RFID tag 16.

As an example of determining physical characteristics of the RFID tag 16 and attached object 20, consider a situation where each face 30, 32 of the object 20 is associated with a particular polarization of electromagnetic signal transmitted from the RFID tag 16. When interrogated by reading antenna system 24, the RFID tag 16 responds with an electromagnetic signal having a particular polarization, and in these illustrative examples the polarization identifies the which face of the object 20 is exposed to or facing the reading antenna system 24. As another example, consider a situation where the polarization of an antenna of the RFID tag 16 is aligned with a rotational orientation of the object 20 (e.g., vertical polarization aligned with upright orientation of the object 20). When interrogated by the reading antenna system 24, the RFID tag 16 responds with an electromagnetic signal having a particular polarization, and in these illustrative examples the polarization identifies the rotational orientation of the object 20 (e.g. a horizontally polarized electromagnetic signal from the RFID tag 16 indicates the object 20 is laying on its side).

Figure 3:
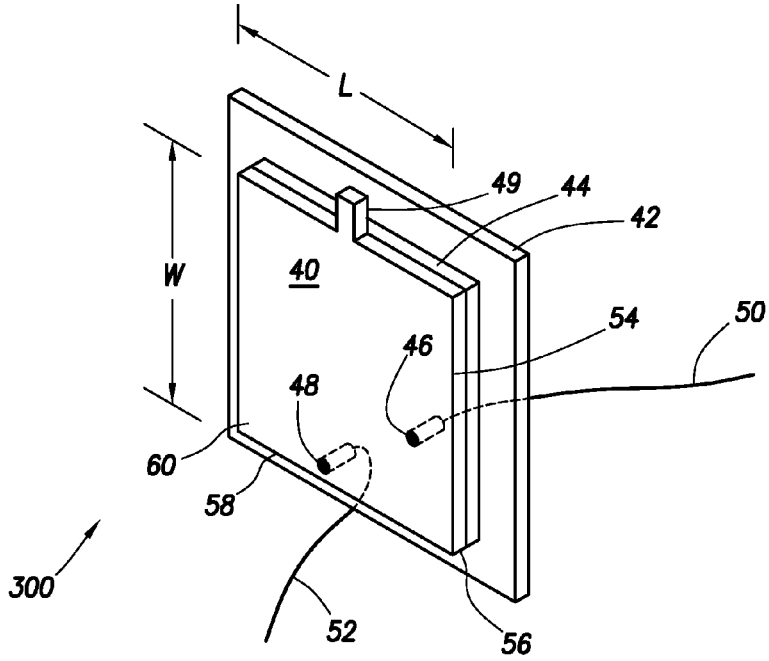
FIG. 3 shows a patch antenna having a plurality of feed points in accordance with at least some embodiments.

In accordance with at least some embodiments, receiving electromagnetic signals from the RFID tag 16, with the electromagnetic signals having varying polarization, is enabled by an antenna system 24 configured to receive electromagnetic signals of varying polarization. In some embodiments, the antenna system 24 comprises a patch antenna having multiple polarizations based on multiple feed points, where each feed point is associated with a different polarization of the patch antenna. FIG. 3 illustrates such a patch antenna 300. In particular, patch antenna 300 comprises an active element or radiative patch 40. The radiative patch 40 comprises a sheet of metallic material (e.g., copper) that defines a perimeter. In the embodiments of FIG. 3, the radiative patch 40 is in the form of a square or rectangle. The length ("L" in the figure) and width ("W" in the figure) of the illustrative radiative patch 40 are based on the wavelength of the radio frequency signal that will be driven to the radiative patch 40 (or that will be received by the radiative patch 40). More particularly, the length and width of the radiative patch 40 are each an integer ratio of the wavelength of the signal to be transmitted (or received). For example, the length L and width W may be approximately half the wavelength ($\lambda/2$) or a quarter of the wavelength ($\lambda/4$).

The patch antenna 30 also comprises a ground plane or ground element 42. The radiative patch 40 and the ground element 42 each define a plane, and those planes are substantially parallel in at least some embodiments. In FIG. 3, the ground element 42 length and width are shown to be greater than the length and width of the radiative patch 40; however, the ground element length and width may be smaller in other embodiments. Although the radiative patch 40 and ground element 42 may be separated by air, in some embodiments a dielectric material 44 (e.g. printed circuit board material, silicon, plastic) separates the radiative patch 40 from the ground element 42.

Radio frequency signals are driven to the antenna element 40 by way of feed points (i.e., the locations where the radio frequency signals couple to the radiative patch 40), such as feed point 46 or feed point 48. The feed points are shown (in dashed lines) to extend through the antenna element 40, dielectric 44 and ground plane 42, and then to couple to respective leads 50 (for feed point 46) and 52 (for the feed point 48). In other embodiments, the leads 50, 52 may extend to their respective feed points through the dielectric material 44, but not through the ground element 42 (i e., the leads emerge from the dielectric material). In yet still other embodiments, the feed points are located on the periphery of the radiative patch 40, such as feed point 49. Using different feed points (e.g. feed points 46, 48 and 49) alone or in combination may produce electromagnetic waves having varying polarization (and configure the antenna to receive electromagnetic waves having varying polarization).

Returning again to FIG. 2, the illustrative patch antenna 300 may be employed as the reading antenna system 24. In this way, a single antenna (e.g., patch antenna 300) can be used to radiate electromagnetic waves of varying polarization (e.g. to radiate interrogating signals to an RFID tag), and likewise to receive electromagnetic waves of varying polarization (e.g. receive responses from RFID tags). In other embodiments, multiple antennas, each antenna having a feed point and configured to radiate (or receive) electromagnetic waves (e.g. multiple dipole antennas in varying orientations), may be used as the reading antenna system 24. The discussion now turns to various mechanisms to control which feed point or points are active, and which feed point or points are inactive, for a particular transmission or reception.

Figure 4:
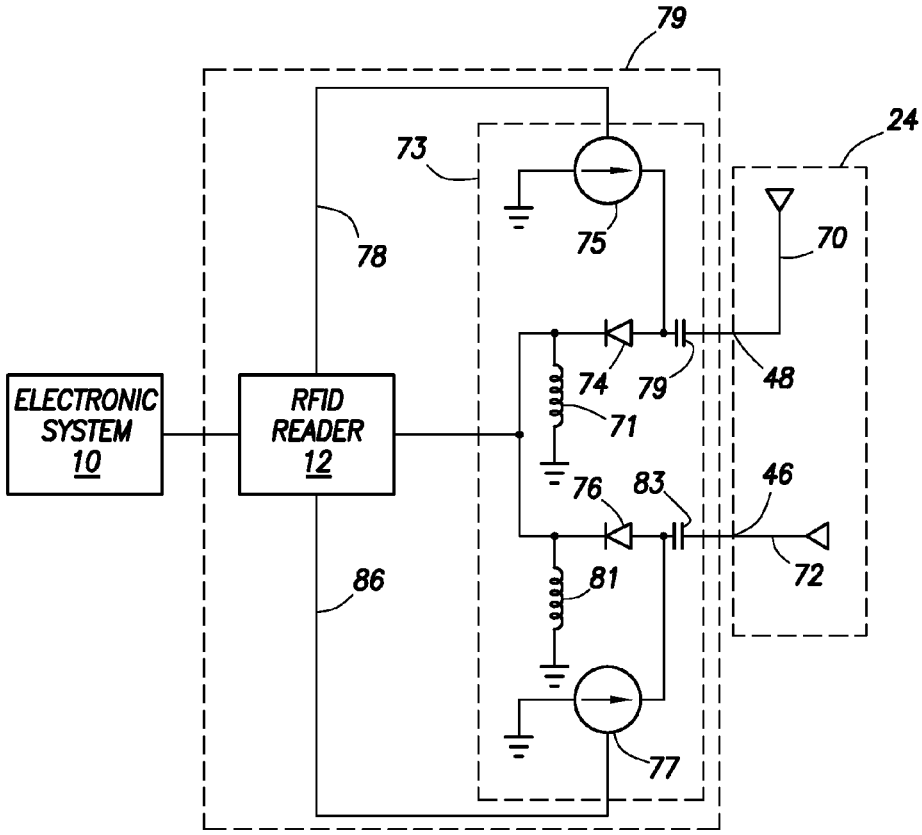
FIG. 4 shows a RFID read/write system in accordance with at least some embodiments.

FIG. 4 shows an electrical block diagram that illustrates coupling of the RFID reader 12 to the reading antenna system 24 in accordance with at least some embodiments. In particular, reading antenna system 24 is illustrated as two antennas 70 and 72. Antenna 70 is schematically shown upright to signify polarization associated with a first feed point (e.g. feed point 48 which, when used, may transmit or receive electromagnetic signals having an illustrative vertical polarization). Likewise, antenna 72 is shown prone to signify polarization associated with a second feed point (e.g. feed point 46 which, when used, may transmit or receive electromagnetic signals having an illustrative horizontal polarization). As discussed above, the reading antenna system may be multiple individual antennas as shown, or the reading antenna system may be a single antenna having multiple feed points where each feed point (or group of feed points) is associated with a different polarization. The RFID reader 12 couples to each feed point through a switch circuit or switch system 73 which, in accordance with at least some embodiments, is implemented as diodes and corresponding controllable constant current sources (e.g., diode 74 and constant current source 75, and diode 76 and constant current source 77).

Consider first a situation where the RFID reader 12 and/or electronic system 10 are configured to transmit electromagnetic signals having an illustrative vertical polarization. In order to make feed point 48 the active feed point, the RFID reader 12 activates the constant current source 75 (e.g. by way of signal line 78). In response to the activation, the constant current source 75 generates or creates a direct current (DC current) having current flow in the direction indicated by the arrow. The electrical current flows through the diode 74 (anode to cathode, thus forward biasing the diode), and then through inductor 71 to ground. In other embodiments, the inductor 71 and/or ground may be within the matching circuit of the RFID reader 12. During the time the diode 74 is forward biased by the DC current from the constant current source 75, the RFID reader 12 generates an antenna feed signal, and the antenna feed signal is applied to the first feed point 48 through the diode 74 and capacitor 79. In turn, the reading antenna 24 radiates an electromagnetic wave having the illustrative vertical polarization.

Figure 5:
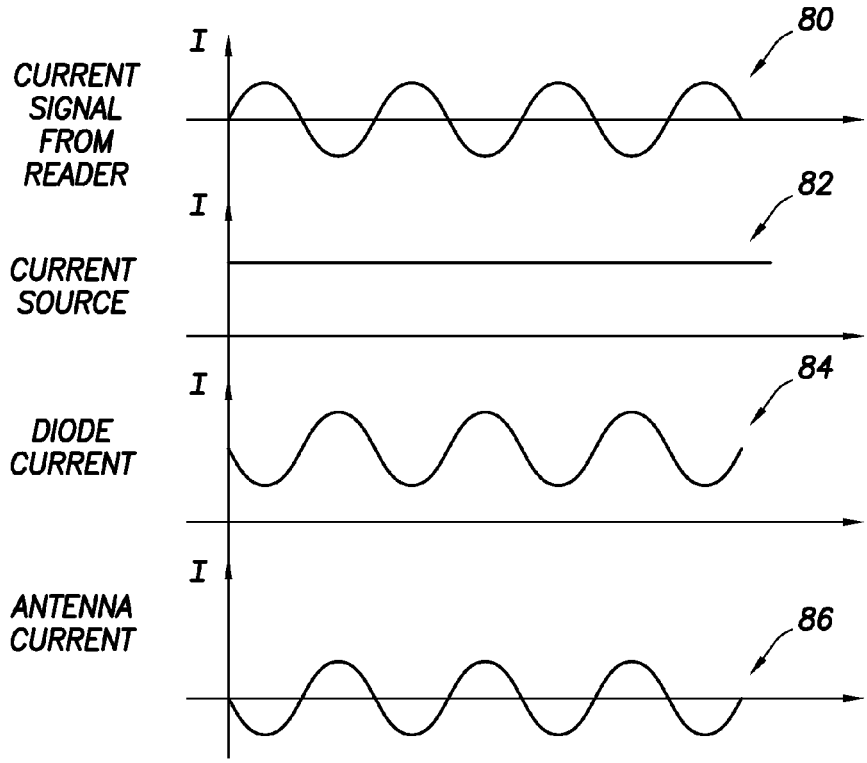
FIG. 5 shows a plurality of signals in accordance with at least some embodiments.

In order to describe how a diode and current source work together to operate as a switch, consider the waveforms of FIG. 5. In particular, FIG. 5 illustrates a current signal 80 from the RFID reader 12 as a function of time. As shown, the current signal 80 is an alternating current (AC) signal having a zero average value. FIG. 5 also shows the DC current 82 from the current source. Finally, FIG. 5 shows resultant diode current 84. The DC current 82 from the current source flows through and forward biases the diode. As the RFID reader 12 generates and applies the current signal 80, the current flow through the diode is affected; however, the DC current 82 supplied by the constant current source 75 is selected to have a greater magnitude than the peak-to-peak current flow of the current signal 80. The result is that during times when the current signal 80 from the RFID reader 12 is positive, the net current through diode 74 is reduced, but the diode 74 remains forward biased. Likewise, during time periods when the current signal from the RFID reader 12 is negative, the net current through the diode is increased, and again the diode 74 remains forward biased. The AC portion of the diode current 84 passes through capacitor 79, while the capacitor 79 blocks the DC current from the antenna. The resulting antenna current applied to the feed point 48 is shown in FIG. 5 as antenna current 86. Thus, by forward biasing the diode 74 with a current of sufficient magnitude (e.g. on the order of amperes during transmission), the diode 74 acts to selectively couple (i.e., controllably couple and decouple) the RFID reader 12 to the feed point 48 of the reading antenna system 24.

Now consider a situation where the RFID reader 12 and/or electronic system 10 are configured to transmit electromagnetic signals having an illustrative horizontal polarization. In order to make feed point 46 the active feed point, the RFID reader 12 activates the constant current source 77 (e.g. by way of signal line 86). In response to the activation, the constant current source 77 generates or creates DC current having current flow in the direction indicated by the arrow. The electrical current flows through the diode 76 (anode to cathode, thus forward biasing the diode), and then through inductor 81 to ground. During the time the diode 76 is forward biased by the DC current from the constant current source 77, the RFID reader 12 generates an antenna feed signal, and the antenna feed signal is applied to the feed point 46 through the diode 76 and capacitor 83 (as discussed with respect to FIG. 5). In turn, the reading antenna 24 radiates an electromagnetic wave having the illustrative vertical polarization.

In the embodiments of discussed with respect to FIG. 4 to this point, the diodes 74 and 76 have been activated in a mutually exclusive manner. That is, diode 74 is forward biased to the exclusion of diode 76, or diode 76 is forward biased to the exclusion of diode 74; however, in systems having more than two feed points, the various feed points may be activated two or more at a time in order to produce (or receive) electromagnetic signals having a desired polarization (e.g., a patch antenna having multiple feed points, where two or more feed points are used to create a right-circularly polarized electromagnetic signal, and two or more other feed points are used to create a left-circularly polarized electromagnetic signal).

Now consider the situation where the RFID reader 12 and/or electronic system 10 are configured to receive vertically polarized electromagnetic signals. In order to make feed point 48 the active feed point, diode 74 is again forward biased by constant current source 75, while diode 76 is not forward biased. Vertically polarized electromagnetic signals incident on the reading antenna system 24 produce AC current at feed point 48. The current at feed point 48 caused by vertically polarized electromagnetic signals passes through capacitor 79 and affects the current flow through the diode 74 in much the same way as the current signal 80 from the RFID reader 12. In other words, the AC current at feed point 48 caused by vertically polarized electromagnetic signals "rides" the DC current from the current source 75 through the diode 74 to the RFID reader 12. Similarly, RFID reader 12 and/or electronic system 10 may be configured to receive vertically polarized electromagnetic signals by forward biasing the diode by constant current source 77 to allow AC current at feed point 46 caused by horizontally polarized electromagnetic signals to pass capacitor 83 and be coupled to the RFID reader 12. In the case of receiving electromagnetic signals, the DC current supplied by the constant current sources 75, 76 may be on the order of milli-Amperes assuming that the reading antenna system 24 is not simultaneously transmitting a signal to be reflected by the RFID tags (e.g. semi-active and passive tags).

Still referring to FIG. 4, in some embodiments the RFID reader 12 and switch system 73 are separate semiconductor devices which are coupled together. That is, the RFID reader 12 may be a separately manufactured semiconductor device from the switch system 73 (i.e., the substrate upon which the RFID reader 12 is manufactured different than the substrate upon which the switch system 73 is manufactured). However, in other embodiments the RFID reader 12 and switch system 73 may be semiconductor devices manufactured on or engaging the same substrate, as indicated by dashed line 79 in FIG. 4.

Figure 6:
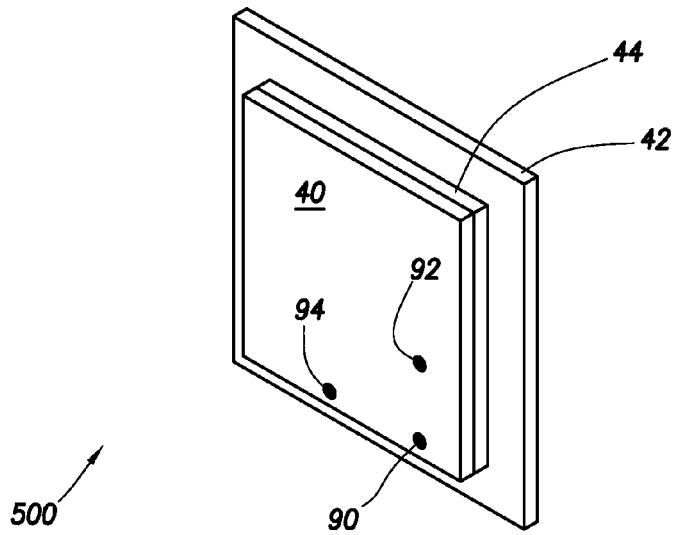
FIG. 6 shows a patch antenna in accordance with at least some embodiments.

The embodiments discussed to this point have been in reference to an antenna system having two feed points, where each feed point is used to the exclusion of the other. However, in other embodiments, three or more feed points are used to increase the number of possible polarizations of the reading antenna, and those polarizations may be formed by use of feed points individually, or use of the feed points in groups. For example, FIG. 6 shows a patch antenna 500 that comprises a radiative patch 40 and ground element 42 separated by dielectric 44. Patch antenna 500 further comprises an illustrative three feed points 90, 92 and 94. When feed point 92 is used alone during transmission, the patch antenna 500 creates an electromagnetic wave with a particular polarization (e.g. horizontal polarization). When feed point 94 is used alone, the patch antenna 500 creates (or receives) an electromagnetic wave with a different polarization (e.g. vertical polarization). When feed points 90 and 92 are used together (to the exclusion of feed point 94), the patch antenna 500 creates (or receives) an electromagnetic wave with yet another polarization (e.g. circular polarization). Likewise, when feed points 90 and 94 are used together (to the exclusion of feed point 92), the patch antenna 500 creates (or receives) an electromagnetic wave with yet still another polarization (e.g. circular polarization, but where the rotational orientation of the polarization is different than that produced when feed points 90 and 92 are used). Thus, a system (such as system 2000 of FIG. 2) may selectively use any polarization that may be transmitted or received by a reading antenna system 24.

Figure 7:
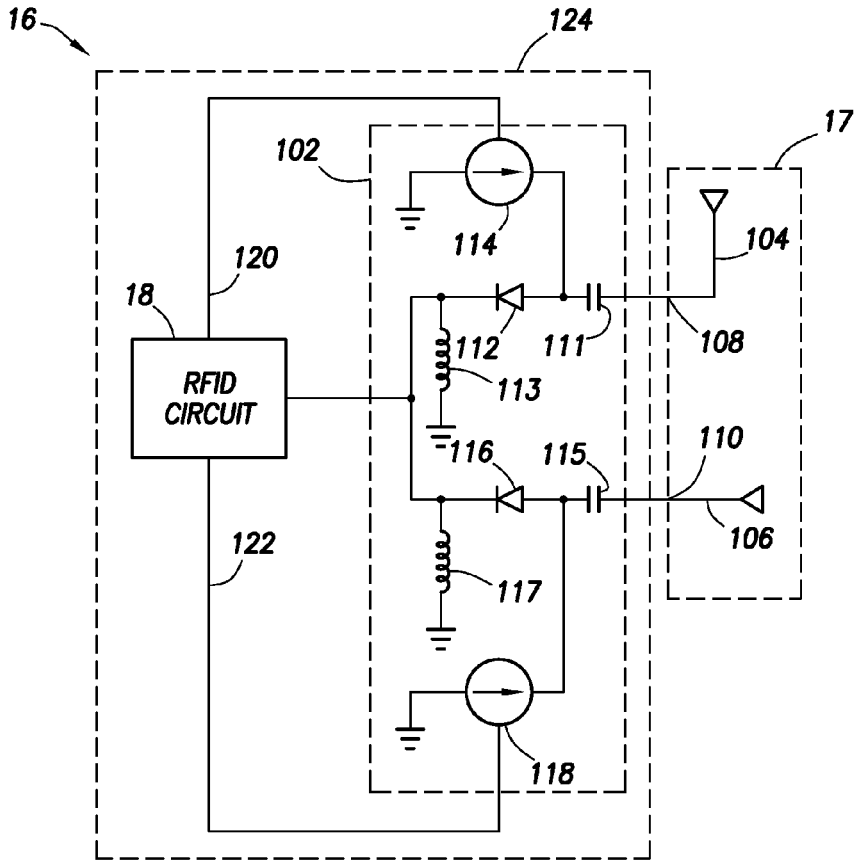
FIG. 7 shows a RFID tag in accordance with at least some embodiments.

The various embodiments discussed to this point have been in relation to the reading antenna system 24 having multiple feed points (whether each feed point is for a separate antenna, or for the same antenna), and having the ability to transmit and receive electromagnetic signals of varying polarization. However, the ability to transmit and receive electromagnetic signals of varying polarization is not limited to the illustrative reading antenna systems 24 and RFID readers 12, and indeed may also be implemented in RFID tags. FIG. 7 shows a RFID tag 16 in accordance with at least some embodiments. In particular, the RFID tag 16 comprises a RFID circuit 18 coupled to a tag antenna system 17 having by way of a switch system 102. The tag antenna system 17 is illustrated as two antennas 104 and 106. Antenna 104 is schematically shown upright to signify polarization associated with a first feed point (e.g., feed point 108 which, when used, may transmit or receive electromagnetic signals having an illustrative vertical polarization). Likewise, antenna 106 is shown prone to signify polarization associated with a second feed point (e.g. feed point 110 which, when used, may transmit or receive electromagnetic signals having an illustrative horizontal polarization). The tag antenna system 17 may be multiple individual antennas as shown, or the tag antenna system 17 may be a single antenna having multiple feed points, where each feed point (or group of feed points) is associated with a different polarization. In accordance with at least some embodiments, the switch system 102 is implemented as diodes and corresponding controllable constant current sources (e.g. diode 112 and constant current source 114, and diode 116 and constant current source 118).

Consider first a situation where the RFID tag 16 is a semi-active or passive tag, waiting to be awakened from a dormant state by an interrogating signal. Even though the RFID tag 16 may be dormant, and thus the controllable constant current sources 114 and 118 not generating currents, the diodes 112 and 116 still conduct if forward biased. When an interrogating signal is incident on the tag antenna system 17, a portion of the current induced on the antenna(s) of the tag antenna system 17 flows through one or both the capacitors 111 and 115 and diodes 112 and 116, respectively. The current that flows through the diode 112 and/or 116, in spite of the fact that the controllable constant current sources 114, 118 are turned off, wakes the RFID tag 16 from the dormant state. In the case of RFID tag 16 being an active tag, the RFID circuit 18 may periodically activate the diodes 112, 116 by way of controllable constant current sources 114, 118 to "listen" for interrogating signals.

Regardless of the type of RFID tag, once activated or awakened by an interrogating signal, the RFID tag 16 is configured to transmit electromagnetic signals, and in some cases the electromagnetic signals have an illustrative vertical polarization. In order to make feed point 108 the active feed point for the illustrative vertical polarization, the RFID circuit 18 activates the constant current source 114 (e.g. by way of signal line 120). In response to the activation, the constant current source 114 generates or creates DC current having current flow in the direction indicated by the arrow. The electrical current flows through the diode 112 (anode to cathode, thus forward biasing the diode), and then through inductor 113 to a ground. In other embodiments, the inductor 113 resides within a matching circuit portion of the RFID circuit 18. During the time the diode 112 is forward biased by the DC current from the constant current source 114, the RFID circuit 18 generates an antenna feed signal, and the antenna feed signal is applied to the first feed point 108 through the diode 112 and capacitor 111. In turn, the tag antenna system 17 radiates an electromagnetic wave having the illustrative vertical polarization. In the case of semi-active and passive RFID tags, the "antenna feed signal" may be a controlled tuning and de-tuning of the antenna by selectively grounding the antenna by way of switch (e.g. a metal oxide semiconductor field effect transistor (MOSFET)) in the RFID circuit 18.

Now consider a situation where the RFID circuit 18 is configured to transmit electromagnetic signals having an illustrative horizontal polarization. In order to make feed point 110 the active feed point, the RFID circuit 100 activates the constant current source 118 (e.g. by way of signal line 122). In response to the activation, the constant current source 122 generates or creates DC current having current flow in the direction indicated by the arrow. The electrical current flows through the diode 116 (anode to cathode, thus forward biasing the diode), and then through inductor 117 to ground. During the time the diode 116 is forward biased by the DC current from the constant current source 118, the RFID circuit 18 generates an antenna feed signal, and the antenna feed signal is applied to the feed point 110 through the diode 116 and capacitor 115. In turn, the tag antenna system 17 radiates an electromagnetic wave having the illustrative vertical polarization. Here again, the "antenna feed signal" may be a controlled tuning and de-tuning of the antenna by selectively grounding the antenna by way of switch in the RFID circuit 18.

In the embodiments of discussed with respect to FIG. 7 to this point, the diodes 112 and 116 have been activated in a mutually exclusive manner. That is, diode 112 is forward biased to the exclusion of diode 116, or diode 116 is forward biased to the exclusion of diode 112; however, in systems having more than two feed points, the various feed points may be activated two or more at a time in order to produce (or receive) electromagnetic signals having a desired polarization (e.g., a patch antenna having multiple feed points, where two or more feed points are used to create a right-circularly polarized electromagnetic signal, and two or more other feed points are used to create a left-circularly polarized electromagnetic signal).

Referring to FIG. 7, now consider situation where the RFID circuit 18 is configured to receive vertically polarized electromagnetic signals containing information (e.g. data to write to the RFID tag 16 or a kill command, and as opposed to a wake signal which actives and/or powers the tag). In order to make feed point 108 the active feed point, diode 112 is again forward biased by constant current source 114, while in this illustrative situation diode 116 is not forward biased. Vertically polarized electromagnetic signals incident on the tag antenna system 17 produce AC current at feed point 108. The current at feed point 108 caused by vertically polarized electromagnetic signals "rides" the DC current from the current source 114 through the diode 112 to the RFID circuit 18. Similarly, the RFID tag 16 may be configured to receive horizontally polarized electromagnetic signals containing information by forward biasing the diode 116 by constant current source 118 to allow AC current at feed point 110 caused by horizontally polarized electromagnetic signals to be coupled to the RFID circuit 18 through the diode 116. In the case of transmitting and/or receiving electromagnetic signals by an RFID tag 16, the DC current supplied by the constant current sources 114 and 118 may be on the order of nano-Amperes.

Still referring to FIG. 7, in some embodiments the RFID circuit 18 and switch system 102 are separate semiconductor devices which are coupled together to form the RFID tag 16. That is, the RFID circuit 18 may be a separately manufactured semiconductor device from the switch system 102 (i.e., the substrate upon which the RFID circuit 18 is manufactured different than the substrate upon which the switch system 102 is manufactured). However, in other embodiments the RFID circuit 18 and switch system 102 may be semiconductor devices manufactured on or engaging the same substrate, as indicated by dashed line 124 in FIG. 7.

Figure 8:
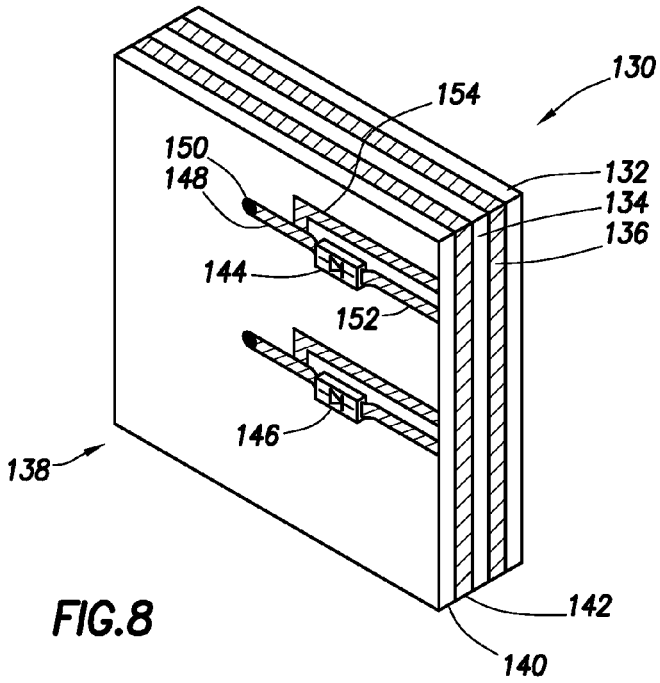
FIG. 8 shows coupling of diodes to a patch antenna in accordance with at least some embodiments.

FIG. 8 illustrates various embodiments of coupling diodes of switch systems (e.g. switch system 73 of FIG. 4, or switch system 102 of FIG. 7) to an antenna. In particular, FIG. 8 illustrates a patch antenna 130 comprising a radiative patch 132 and a ground element 134 separated by a dielectric material 136. On a back side 138 of the patch antenna 130 is a printed circuit board (PCB) layer 140 separated from the ground element 134 by a dielectric material 142. For an illustrative system having two feed points to the radiate patch 132, each feed point has associated therewith (e.g., diodes 144 and 146). Other electronic components, such as the capacitors and inductors in FIGS. 4 and 7, may be similarly associated. The illustrative diodes in these embodiments are mechanically coupled to the patch antenna 130, and in particular mechanically coupled to the PCB layer 140. A plurality of electrical traces on the PCB layer 140 enable electrical coupling of the diodes 144, 146 to their respective locations. For example, the anode of diode 144 electrically couples by way of electrical trace 148 to a via 150 (the via enabling electrical coupling to a feed point of the radiative patch 132). Another electrical trace 152 enables coupling of the cathode of diode 144 to a RFID circuit 18 or a RFID reader 12. Yet another electrical trace 154 enables coupling of the anode side of diode 144 to the source of controllable constant current source. Equivalent electrical traces exist for diode 146. In the illustrative FIG. 8, the diodes 144 and 146 are separate components, thus built upon and engaging different substrates.

Figure 9:
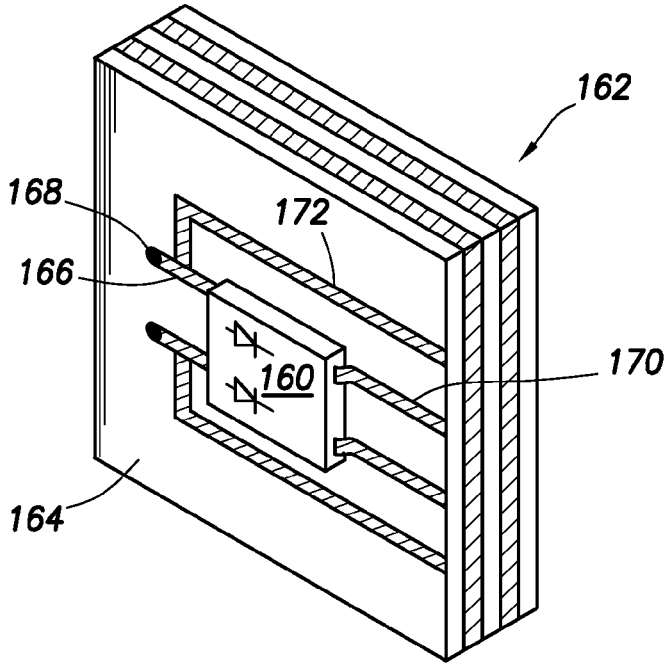
FIG. 9 shows coupling of diodes to patch antenna in accordance with some embodiments.

FIG. 9 shows a system where the diodes engage the same substrate, and are thus embodied in the same semiconductor device. In particular, FIG. 9 illustrates a semiconductor device 160 mechanically coupled to the patch antenna 162, and in particular the PCB layer 164. A plurality of electrical traces on the PCB layer 164 enable electrical coupling of the diodes in the semiconductor device 160 to their respective feed points. For example, one diode of the semiconductor device 160 electrically couples by way of electrical trace 166 to a via 168 (the via enabling electrical coupling to a feed point of the radiative patch). Another electrical trace 170 enables coupling of the diode of the semiconductor device 160 to a RFID circuit 100 or a RFID reader 12. Yet another electrical trace 172 enables coupling of the anode side of diode of the semiconductor device 160 to the source of controllable constant current source. Other electronic components, such as the capacitors and inductors in FIGS. 4 and 7, may be similarly associated. Equivalent electrical traces exist for second diode of the semiconductor device 160. Here again, while the semiconductor device 160 is illustrated as coupling to two feed points through two vias, the semiconductor device 160 may couple to a plurality of feed points, and the number is not limited to two.

Figure 10:
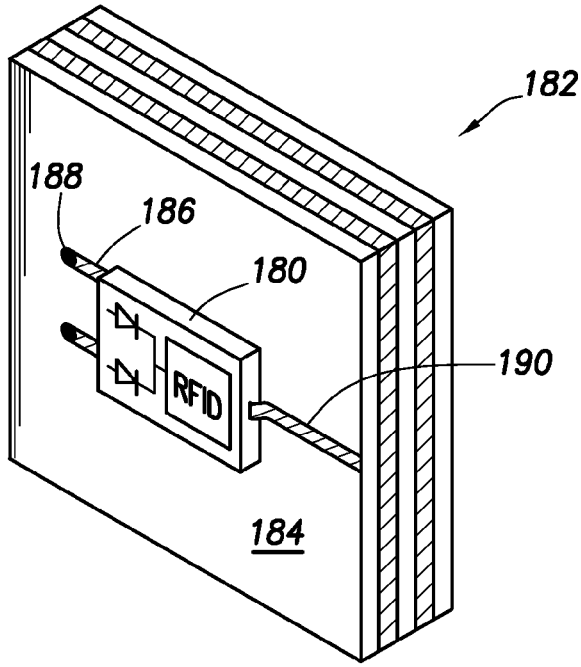
FIG. 10 shows coupling of a semiconductor device comprising diodes and a RFID component in accordance with some embodiments.

FIG. 10 shows a system where the diodes as well as other RFID components engage the same substrate. In particular, FIG. 10 illustrates a semiconductor device 180 mechanically coupled to the patch antenna 182. In the embodiments illustrated by FIG. 10, the semiconductor device 180 comprises not only a plurality of diodes, but also a RFID component. Other electronic components, such as the capacitors and inductors in FIGS. 4 and 7, may be similarly associated. In some embodiments, the RFID component is a RFID circuit, and as such the patch antenna 182 and semiconductor device 180 may be an RFID tag. In other embodiments, the RFID component is a RFID reader, and as such the patch antenna 182 and semiconductor device 180 may be a portion of a system read/write RFID tags. Regardless of the precise nature of the RFID component, a plurality of electrical traces on the PCB layer 184 enable electrical coupling of diodes in the semiconductor device 180 to their respective feed points. For example, one diode of the semiconductor device 180 electrically couples by way of electrical trace 186 to a via 188 (the via enabling electrical coupling to a feed point of the radiative patch). In the case of semiconductor device 180 being part of an RFID tag, electrical traces for coupling to other devices may not be needed. In the case of semiconductor device 180 being part of a system read/write RFID tags, another electrical trace 190 enables coupling of the RFID component to external systems (e.g. electronic system 10). Equivalent electrical traces exist for coupling the semiconductor device 180 to other feed points.

Figure 11:
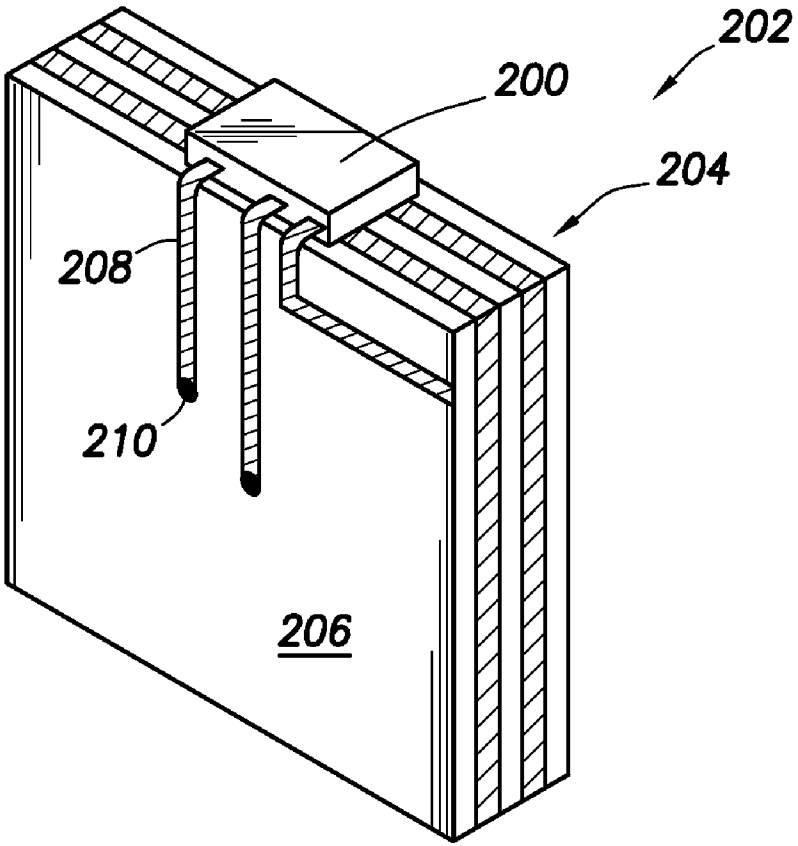
FIG. 11 shows coupling of a semiconductor device in accordance with some embodiments.

FIG. 11 shows a system where the diodes and/or other RFID components engage the same substrate, and are mechanically coupled to a patch antenna. In particular, FIG. 11 illustrates a semiconductor device 200 mechanically coupled to the patch antenna 202 on a side 204. In the embodiments illustrated by FIG. 11, the semiconductor device 200 may comprise diodes only, or diodes and other RFID components. Thus, like FIG. 10, the semiconductor device 200 and patch antenna 202 may form a RFID tag, or a portion of a system to read/write RFID tags. Regardless of the precise nature of the RFID component (if present), a plurality of electrical traces on the PCB layer 206 enable electrical coupling of diodes in the semiconductor device 200 to their respective feed points. For example, one diode of the semiconductor device 200 electrically couples by way of electrical trace 208 to a via 210 (the via enabling electrical coupling to a feed point of the radiative patch). Equivalent electrical traces exist for coupling the semiconductor device 180 to other feed points. In the case of semiconductor device 200 being part of an RFID tag, electrical traces for coupling to other devices may not be needed. In the case of semiconductor device 180 being part of a system read/write RFID tags, another electrical trace 212 enables coupling of the RFID component to external systems (e.g. electronic system 10).

The above discussion is meant to be illustrative of the principles and various embodiments of the present invention. Numerous variations and modifications will become apparent to those skilled in the art once the above disclosure is fully appreciated. For example, the capacitors in FIGS. 4 and 7 that block the DC current from the constant current sources from flowing to the antenna are not strictly required. In situations where individual antennas are used one each for each polarization, no DC current path through the antenna is present and thus the capacitors may be omitted. It is intended that the following claims be interpreted to embrace all such variations and modifications.

What is claimed is:

1. A system comprising:

an antenna system having a single antenna structure, the single antenna structure having a first feed point coupled to a first capacitor, and a second feed point coupled to a second capacitor, wherein the first feed point transmits a first interrogation signal in response to a first antenna current and the second feed point transmits a second interrogation signal in response to a second antenna current;

an antenna communication circuit configured to output an alternating current signal having an average value of zero;

a first current source coupled to the antenna communication circuit and configured to output a first direct current signal responsive to an antenna selecting signal from the antenna communication circuit, wherein the first direct current signal has a greater magnitude than a peak-to-peak value of the alternating current signal;

a first diode coupled to the antenna communication circuit to receive the alternating current signal, and coupled to the first current source and the first capacitor, wherein the first diode is forward biased by the first direct current signal to output a first diode alternating current signal with a first direct current component to the first capacitor, the first capacitor removing the first direct current component from the first diode alternating signal to provide the first antenna current to the first feed point;

a second current source coupled to the antenna communication circuit and configured to output a second direct current signal responsive to an antenna selecting signal from the antenna communication circuit, wherein the second direct current signal has a greater magnitude than a peak-to-peak value of the alternating current signal; and a second diode coupled to the antenna communication circuit to receive the alternating current signal, and coupled to the second current source and the second capacitor, wherein the second diode is forward biased by the second direct current signal to output a second diode alternating current signal with a second direct current component to the second capacitor, the second capacitor removing the second direct current component from the second diode alternating signal to provide the second antenna current to the second feed point.

2. The system according to claim 1 wherein the antenna structure further comprises:

a radiative patch that defines a perimeter; and a ground element, the radiative patch parallel and proximate to the ground element;

wherein the first and second feed points are one or more selected from the group consisting of:

within the perimeter; and disposed on the perimeter.

3. The system according to claim 1 wherein the antenna structure further comprises:

a first antenna having a first polarization when the first feed point is used; and a second antenna having a second polarization when the second feed point is used.

4. The system according to claim 1 wherein the antenna communication circuit is one or more selected from the group consisting of:

a radio frequency identification (RFID) reader; and a RFID circuit within an RFID tag.

5. A semiconductor device comprising:

a substrate;

a first diode engaging the substrate, wherein the first diode is coupled to a first feed point of a single antenna structure of an antenna system, the first feed point transmitting a first interrogation signal in response to a first antenna current;

a first capacitor disposed between the first diode and the first feed point;

a second diode engaging the substrate, wherein the second diode is coupled to a second feed point of the single antenna structure of the antenna system, the second feed point transmitting a second interrogation signal in response to a second antenna current;

a second capacitor disposed between the second diode and the second feed point;

a radio frequency identification (RFID) circuit engaging the substrate, wherein the RFID circuit comprises an antenna signal line coupled to the first and second diodes, the RFID circuit outputting to the antenna signal line an alternating current signal having an average value of zero; and a current source coupled to the RFID circuit, the first and second diodes, and the first and second capacitors, wherein the current source is configured to output a direct current signal having a greater magnitude than a peak-to-peak value of the alternating current signal, the first and second diodes being forward biased by the direct current signal responsive to a respective antenna selecting signal from the RFID circuit, wherein the forward biased first diode outputs a first diode alternating current signal with a first direct current component to the first capacitor, the first capacitor removing the first direct current component from the first diode alternating signal to provide the first antenna current to the first feed point, and wherein the forward biased second diode outputs a second diode alternating current signal with a second direct current component to the second capacitor, the second capacitor removing the second direct current component from the second diode alternating signal to provide the second antenna current to the second feed point.

6. The system according to claim 1 wherein the antenna communication circuit is a radio frequency identification (RFID) reader; and the system further comprises a RFID tag communicatively coupled to the RFID reader.

7. The system according to claim 6 wherein the RFID tag further comprises:

a tag antenna having a plurality of third feed points;

a RFID circuit; and a plurality of third diodes, wherein at least one of the third diodes is coupled between each of the plurality of third feed points and the RFID circuit;

wherein the RFID circuit is configured to selectively apply an antenna signal to the tag antenna through at least one of the third diodes.

8. The system according to claim 7 wherein when the RFID circuit selectively applies the antenna signal the RFID circuit is configured to apply a bias current to a selected one of the plurality of third diodes.

9. The system according to claim 7 further comprising a power source coupled to the RFID circuit.

10. A method comprising:

outputting an alternating current signal from an antenna communication circuit to a first diode and to a second diode, wherein the alternating current signal has an average value of zero;

selectively coupling the antenna communication circuit to first and second feed points of an antenna system, wherein the first feed point is coupled to the first diode and the second feed point is coupled to the second diode and the first and second diodes are coupled to the feed points through a first capacitor and second capacitor, respectively, the selectively coupling comprising:

selectively applying a constant first forward biasing current to forward bias the first diode to select communication through the first feed point such that the first diode outputs a first diode alternating current signal with a first direct current component, wherein the constant first forward biasing current has a greater magnitude than a peak-to-peak value of the alternating current signal;

removing the first direct current component from the first diode alternating current signal with the first capacitor resulting in a first antenna current being provided to the first feed point;

selectively applying a constant second forward biasing current to forward bias the second diode to select communication through the second feed point such that the second diode outputs a second diode alternating current signal with a second direct current component, wherein the constant second forward biasing current has a greater magnitude than a peak-to-peak value of the alternating current signal; and removing the second direct current component from the second diode alternating current signal with the second capacitor resulting in a second antenna current being provided to the second feed point.

11. The method according to claim 10 wherein selectively coupling further comprises selectively coupling the antenna communication circuit to a patch antenna embodying said first and second antennas and having the first and second feed points.

12. The method according to claim 10 wherein selectively coupling further comprises selectively coupling the antenna communication circuit to at least one selected from the group consisting of:

a first antenna having the first feed point; and a second antenna having the second feed point.

13. The method according to claim 10 wherein the antenna communication circuit is a radio frequency identification (RFID) reader.

14. The method according to claim 10 wherein the antenna communication circuit is a radio frequency identification (RFID) circuit.

* * * * *

UNITED STATES PATENT AND TRADEMARK OFFICE

CERTIFICATE OF CORRECTION

PATENT NO. : 7,936,268 B2
APPLICATION NO. : 11/848295
DATED : May 3, 2011
INVENTOR(S) : John R. Tuttle It is certified that error appears in the above-identified patent and that said Letters Patent is hereby corrected as shown below:

On the cover page after (74) Attorney, Agent, or Firm — "Kromholz" should read --Krumholz--.

Signed and Sealed this
First Day of May, 2012

David J. Kappos

David J. Kappos
*Director of the United States Patent and Trademark Office*